US006293827B1

(12) United States Patent
Stokoe

(10) Patent No.: US 6,293,827 B1
(45) Date of Patent: Sep. 25, 2001

(54) DIFFERENTIAL SIGNAL ELECTRICAL CONNECTOR

(75) Inventor: Philip T. Stokoe, Attleboro, MA (US)

(73) Assignee: Teradyne, Inc., Boston, MA (US)

( * ) Notice: Subject to any disclaimer, the term of this patent is extended or adjusted under 35 U.S.C. 154(b) by 0 days.

(21) Appl. No.: 09/498,256

(22) Filed: Feb. 3, 2000

(51) Int. Cl.[7] ..... H01R 13/648
(52) U.S. Cl. ..... 439/608; 439/108
(58) Field of Search ..... 439/607–610, 439/79, 95, 100, 108, 109, 101

(56) References Cited

U.S. PATENT DOCUMENTS 4,846,727 * 7/1989 Glover et al. ..... 439/608
5,507,655 * 4/1996 Goelich ..... 439/108
5,516,294 * 5/1996 Andrews et al. ..... 439/607
5,620,340 * 4/1997 Andrews ..... 439/608
5,660,551 * 8/1997 Sakurai ..... 439/108
5,664,968 * 9/1997 Mickievicz ..... 439/608
5,904,594 * 5/1999 Longueville et al. ..... 439/608

* cited by examiner

*Primary Examiner*—Lincoln Donovan
(74) *Attorney, Agent, or Firm*—Teradyne Legal Dept.

(57) ABSTRACT

A high speed, high density electrical connector. The disclosed embodiments are principally configured for carrying differential signals, though other configurations are discussed. For differential signals, the signal conductors are arranged in pairs and shield strips run parallel to each pair. The connector is manufactured with wafer assemblies. Separate signal and shield wafers are formed. The signal wafers interlock to position signal conductors in pairs and then the shield waters are attached. A cap is placed on the signal wafer assembly to protect contact elements.

20 Claims, 10 Drawing Sheets

DIFFERENTIAL SIGNAL ELECTRICAL CONNECTOR

This invention relates generally to electrical connectors for electronic systems and more particularly to electrical connectors for high speed, high density systems.

Electrical connectors are used in many electronic systems. It is generally easier and more cost effective to manufacture a system on several printed circuit boards which are then joined together with electrical connectors.

A traditional arrangement for joining several printed circuit boards is to have one printed circuit board serve as a backplane. Other printed circuit boards, called daughter boards, are connected through the backplane.

A traditional backplane is a printed circuit board with many connectors. Conducting traces in the printed circuit board connect to signal pins in the connectors so that signals may be routed between the connectors. Other printed circuit boards, called "daughter boards" also contain connectors that are plugged into the connectors on the backplane. In this way, signals are routed among the daughter boards through the backplane. The daughter cards often plug into the backplane at a right angle. The connectors used for these applications contain a right angle bend and are often called "right angle connectors."

Connectors are also used in other configurations for interconnecting printed circuit boards, and even for connecting cables to printed circuit boards. Sometimes, one or more small printed circuit boards are connected to another larger printed circuit board. The larger printed circuit board is called a "mother board" and the printed circuit boards plugged into it are called daughter boards. Also, boards of the same size are sometimes aligned in parallel. Connectors used in these applications are sometimes called "stacking connectors" or "mezzanine connectors."

Regardless of the exact application, electrical connector designs have generally needed to mirror trends in the electronics industry. Electronic systems generally have gotten smaller and faster. They also handle much more data than systems built just a few years ago. To meet the changing needs of these electronic systems, some electrical connectors include shield members. Depending on their configuration, the shields might control impedance or reduce cross talk so that the signal contacts can be placed closer together.

An early use of shielding is shown in Japanese patent disclosure 49-6543 by Fujitsu, Ltd. dated Feb. 15, 1974. U.S. Pat. Nos. 4,632,476 and 4,806,107—both assigned to AT&T Bell Laboratories—show connector designs in which shields are used between columns of signal contacts. These patents describe connectors in which the shields run parallel to the signal contacts through both the daughter board and the backplane connectors. Cantilevered beams are used to make electrical contact between the shield and the backplane connectors. U.S. Pat. Nos. 5,433,617; 5,429,521; 5,429,520 and 5,433,618—all assigned to Framatome Connectors International—show a similar arrangement. The electrical connection between the backplane and shield is, however, made with a spring type contact.

Other connectors have the shield plate within only the daughter card connector. Examples of such connector designs can be found in U.S. Pat. Nos. 4,846,727; 4,975,084; 5,496,183; 5,066,236—all assigned to AMP, Inc. An other connector with shields only within the daughter board connector is shown in U.S. Pat. No. 5,484,310, assigned to Teradyne, Inc.

Another modification made to connectors to accommodate changing requirements is that connectors must be much larger. In general, increasing the size of a connector means that manufacturing tolerances must be much tighter. The permissible mismatch between the pins in one half of the connector and the receptacles in the other is constant, regardless of the size of the connector. However, this constant mismatch, or tolerance, becomes a decreasing percentage of the connector's overall length as the connector gets larger. Therefore, manufacturing tolerances must be tighter for larger connectors, which can increase manufacturing costs. One way to avoid this problem is to use modular connectors. Teradyne Connection Systems of Nashua, N.H., USA pioneered a modular connector system called HD+®, with the modules organized on a stiffener. Each module had multiple columns of signal contacts, such as 15 or 20 columns. The modules were held together on a metal stiffener.

An other modular connector system is shown in U.S. Pat. Nos. 5,066,236 and 5,496,183. Those patents describe "module terminals" with a single column of signal contacts. The module terminals are held in place in a plastic housing module. The plastic housing modules are held together with a one-piece metal shield member. Shields could be placed between the module terminals as well.

A state of the art modular electrical connector is shown in U.S. Pat. Nos. 5,980,321 and 5,993,259 (which are hereby incorporated by reference). That patent shows a plurality of modules, each assembled from two wafers, held together on a metal member, called a "stiffener." The assignee of those patents, Teradyne, Inc, sells a commercial embodiment under the name VHDM.

FIG. 1 is reproduced from U.S. Pat. No. 5,980,321. FIG. 1 shows an example of a "right angle" connector. It is used to connect a backplane 110 to a daughter card 112. The daughter card portion of the connector is made from two pieces—a ground wafer 166 and a signal wafer 168.

Signal wafer 168 contains a plurality of signal contacts. A housing 172 is molded around the contacts to hold them together. Ground wafer 166 is made from a one-piece metal plate. Plastic is molded around the plate to form an insulative portion 170.

FIG. 1 shows an exploded view of a module 154. In use, the signal wafer and ground wafers are securely fastened to each other. Mating regions 158 of the signal contacts are inserted into the insulative portion 170 and are thereby protected.

The module 154 is attached to a support member, which in FIG. 1 is shown as a metal stiffener 156. The metal stiffener 156 contains features 160A, 162A and 164A that receive complementary features on module 154. Those features are illustrated as 160B, 162B and 164B and are formed from the plastic used in molding signal wafer 168. For simplicity, FIG. 1 shows a single module 154. In use, many modules would likely be assembled to a support member to form a connector that would typically be several inches long.

The daughter card connector 116 mates with a pin header 114. Pin header 114 contains parallel columns of signal contacts 122 that engage with the signal contacts at their mating ends 158. In use, the connection between daughter card connector 116 and pin header 114 is separable. This separable connection allows daughter cards to be easily installed and removed from a backplane system. FIG. 1 shows that pin header 114 contains backplane shields 128 between adjacent columns of pin. While backplane shields 128 improve electrical performance, not all connectors need or use shielding in the backplane connector.

Another variation of a modular connector is described in U.S. patent application Ser. No. 09/199,126 (which is hereby incorporated by reference). The assignee of that application, Teradyne, Inc, sells a commercial embodiment under the name HSD. That application also shows a connector in which modules, each assembled from two wafers, are held together on a metal stiffener. These wafers differ from the wafers shown in the U.S. Pat. Nos. 5,980,321 and 5,993,259 in that these wafers have signal contacts with non-uniform spaces. In particular, the signal contacts are arranged in pairs. Each pair carries one differential signal. A differential signal is represented as the difference in voltage levels between two conductors. Differential signals are often used at high speeds because they are much less susceptible to noise than single ended signals. In an ideally balanced pair, noise affects both conductors in the pair the same. Therefore, the difference between the pair of conductors should ideally not be affected by noise.

It would be highly desirable if a connector could be made with greater density. Density refers to the number of signals that can be carried through each inch of the connector. It would also be highly desirable if a connector could be made to carry higher speed signals.

SUMMARY OF THE INVENTION

With the foregoing background in mind, it is an object of the invention to provide a high speed and high density electrical connector.

It is also an object to provide a high speed, high density differential connector.

The foregoing and other objects are achieved in an electrical connector having signal contacts arranged in pairs. Shielding strips are used between adjacent pairs.

In a preferred embodiment, the shielding strips are electrically isolated from each other such that there is less chance of resonance or other affects that could limit high frequency performance of the connector.

In other embodiments, the connector is tailored for differential signals. For each pair of signal contacts, the longer conductor in each pair is surrounded by a lower dielectric constant than the shorter conductor of the pair, thereby reducing the skew between the conductors of the pair.

In yet other embodiments, the width of the shielding strips is varied based on the length of the signal contacts adjacent to them in order to increase the resonant frequency of the connector.

In yet other embodiments, the signal conductors are shaped with curves to avoid corners that reduce signal integrity.

BRIEF DESCRIPTION OF THE DRAWINGS

The invention will be better understood by reference to the following more detailed description and accompanying drawings in which.

DESCRIPTION OF THE PREFERRED EMBODIMENT

Figure 1:
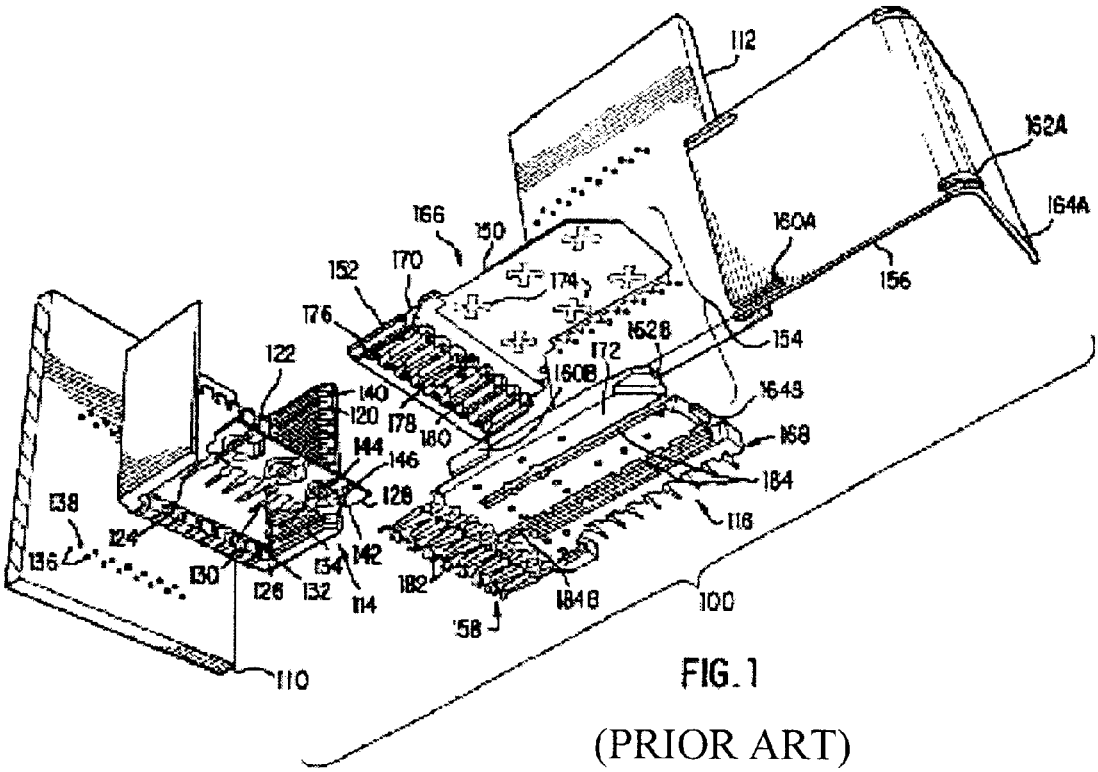
FIG. 1 (PRIOR ART)
FIG. 1 is a sketch showing an exploded view of a prior art waferized.
Figure 2:
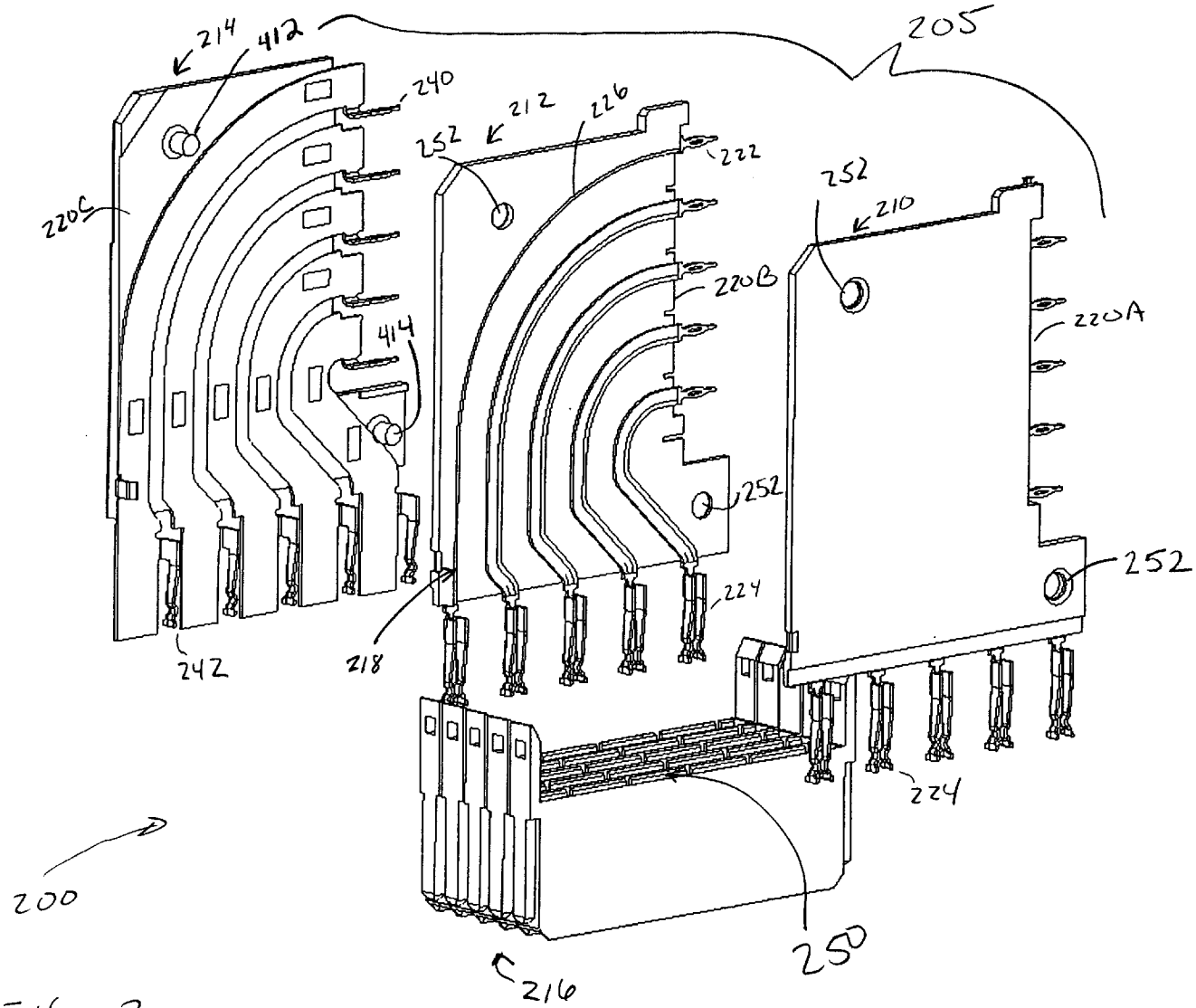
FIG. 2 is a sketch showing an exploded vies of a daughter card connector according to the invention.

FIG. 2 shows an exploded view of connector module 200, which in FIG. 2 is illustrated as a right angle module. In use, it is likely that a connector would be made up of several such modules attached to a printed circuit board. In a preferred embodiment, the modules 200 would be first attached to a support member, such as metal stiffener 156 (FIG. 1). Attachment features are not expressly shown, but features such as 160B, 162B and 164B (FIG. 1) would be included to attach module 200 to a stiffener.

Module 200 as illustrated in FIG. 2 contains four types of components: signal wafers 210 and 212, shield wafer 214 and cap 216. Signal wafers 210 and 212 have similar construction. However, they have complementary features so that they will lock together.

Each of the signal wafers 210 and 212 has a plurality of signal conductors 218 that are held in an insulative housing 220A or 220B. Each conductor 218 has a tail portion 222, a mating portion 224 and an intermediate portion 226. Tail portions 222 provide a point for electrical connection to the signal conductor. In the illustrated embodiment, of a right angle board to backplane connector, tail portions 222 would, in operation, engage a printed circuit board, such as board 112 (FIG. 1). In the illustrated embodiment, tail portions 222 are shown to be press fit contact tails that would, as is known in the art, engage a plated hole in a printed circuit board.

Mating portions 224 are adapted to engage a mating signal conductor in a mating connector. FIG. 2 shows that mating portions 224 are shaped as opposed beam contacts. In the illustrated embodiment, the mating connector will be a pin header 114 (FIG. 1) and the mating contacts will be pins 122. However, it is not necessary that backplane shields 128 be included in pin header 114 and the description that follows is based on a pin header 114 that does not include shields 128.

Also, in the preferred embodiments, the signal contacts in the mating connector 114 are wider than they are thick. By way of example, the signal contacts in the mating connector are approximately 0.5 mm wide and 0.3 mm thick. Contacts with such an aspect ration might be referred to as "blades" rather than "pins." In the preferred embodiment, the narrow axes of the blades run along the columns. The columns of blades are preferably spaced apart between 1.85 mm and 2 mm on center. Within a column, there will be pairs of signal blades. In the illustrated embodiment, there are 5 pairs of signal blades. The blades in each pair are spaced 1.5 mm on center and the pairs are spaced 4 mm on center. Between each pair of signal blades, there is a ground blade.

The signal blades and the ground blades can be identical. In a preferred application of the connector, each pair of signal blades will be connected to traces that carry differential signal within backplane 110. The ground blades will be connected to ground traces within backplane 110. Optionally, all of the ground blades could be connected together within header 114. This arrangement results in differential pairs being interspersed with ground contacts— which is a preferred application for carrying high speed signals. It should be appreciated, though, that the structure of the invention might be applied in alternative applications.

Figure 3:
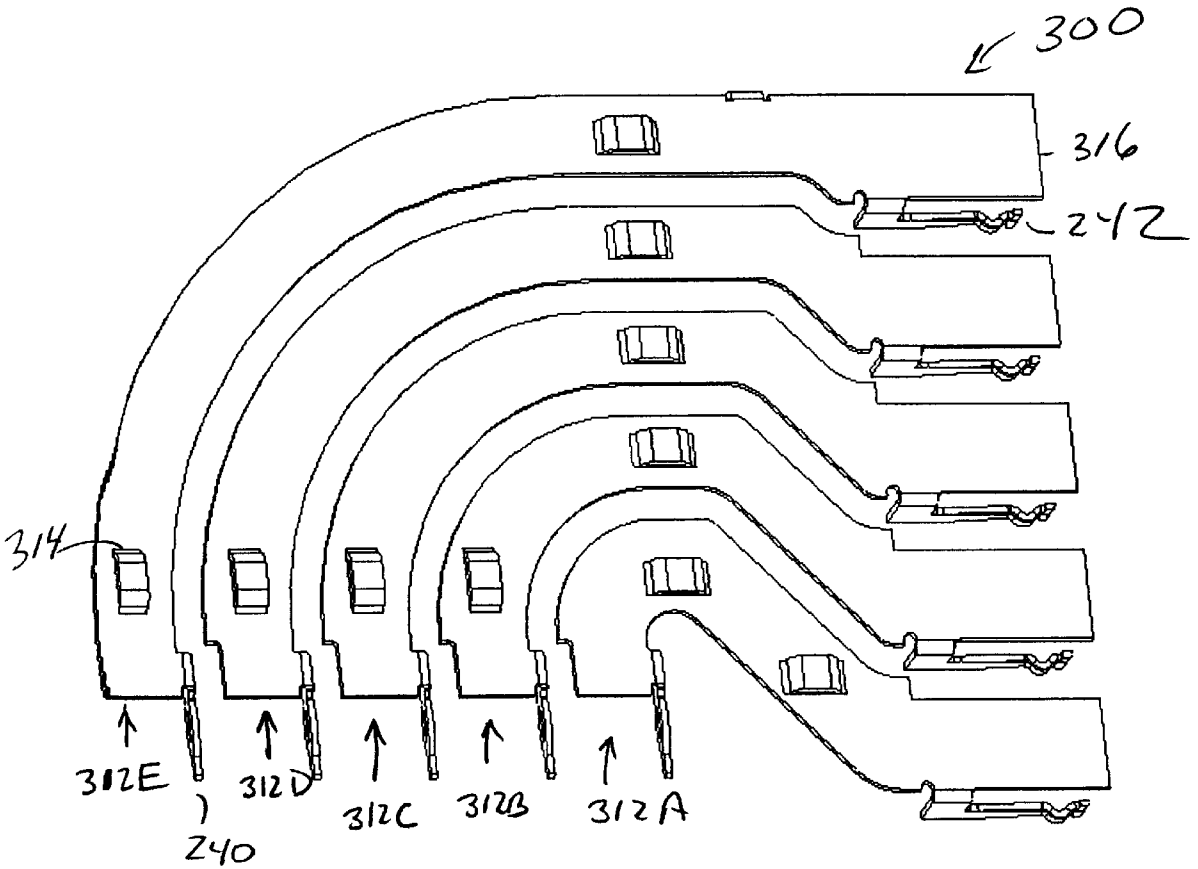
FIG. 3 is a sketch of the shield blank used to make the shield wafer of the connector of FIG. 2.

Shield wafer 214 also includes an insulative housing 220C. Encapsulated within the insulative housing a plurality, here five, of shield strips 312A . . . 312E (FIG. 3). Each shield strip 312A . . . 312B contains a tail portion 240 and a mating contact 242. The tail portions 240 resemble tail portions 222 on signal wafers 210 and 212 and are likewise adapted to engage a printed circuit board. It should be noted, though, that in the illustrated embodiment, the tail portions 240 are bent at a right angle to the major plane of the shield strips 312A . . . 312E. This bend has the effect of giving tails 240 an orientation that is rotated 90 degrees relative to tails 222. Mating contacts 242 engage the ground blades of pin header 114 (FIG. 1). Mating contacts 242 are here illustrated as single beam contacts.

Wafers 210, 212 and 214 are assembled into a wafer assembly 205. When wafer assembly 205 is formed, the mating contact portions 224 from signal wafers 210 and 212 and the mating contact portions 242 from shield wafer 214 will align to create one column. Each will engage a blade from pin header 114 (FIG. 1). As described more fully in conjunction with FIG. 9 below, the mating contacts 224 from signal wafers 210 and 212 will alternate in the column to create pairs of mating contacts with one mating contact attached to each of the signal wafers 210 and 212. A mating contact portion 242 from shield wafer 214 will be interspersed between each pair of mating contacts 224 and a tail 240 will be interspersed between each pair of tails 222. This positioning creates hole patterns on the backplane 1120 and printed circuit board 112 that have a ground hole between each pair of signal holes.

In a wafer assembly 205, signal wafers 210 and 212 and shield wafer 214 are mechanically connected. In one embodiment, each of the wafers will include snap fit features for attachment. An alternative to snap fit attachment is an interference fit attachment. Alternatively, pins or rivets could be passed through the wafers for securing them together. Similarly, lances could be struck from some of the shield strips 312A . . . . 312E for securing the wafers into an assembly. Adhesives might also be used for mechanically securing the wafers together. Alternatively, bonding of plastic of the wafers could be used to hold the wafers together. In the illustrated example, projections 412 and 414 are formed in insulative housing 220C and are pressed through holes 252 in housings 220A and 220B, thereby holding the assembly together.

Once the wafers are assembled, they are inserted into cap 216. Cap 216 has openings 250 that receive the mating contact portions 224 and 242. Cap 216 is preferably made of an insulative material, such as plastic. FIG. 2 shows cap 216 sized to receive four wafer assemblies 205. Cap 216 could be made of arbitrary width to receive any number of wafer assemblies. In some embodiments, cap 216 will be wide enough to receive only a single wafer subassembly. Such a configuration is preferred when backplane shields 128 are used. Any convenient method can be used to secure the wafer assemblies to cap 216. In the illustrated embodiment, snap fit features are used.

In a preferred embodiment, cap 216 will have an opening 250 that creates an area to receive the receptacles 224 of the signal contact wafer and the beams 242 of the shield wafers. The cap will preferably have features inside of opening 250 to position the receptacles 224 and beams 242 in the appropriate locations. It will have holes with lead-ins that direct blades from the mating electrical connector into engagement with the mating portions 224 and 242. In addition, features inside cap 216 will spread the beams of mating contacts 224 to a desired opening distance to reduce insertion force. Further, those features will protect the free ends of the beams of the mating contacts to ensure that they do not stub on the blades as they are inserted from the mating electrical connector.

Turning now to FIG. 3, a shield blank 300 is shown. In a preferred manufacturing operation, shield wafers 214 will be formed by insert molding plastic around shield blank 300 to form housing 220C. Insert molding housing 220C around shield blank 300 will secure the shield strips 312A . . . 312E in place. One way to form shield blank 300 is to stamp the structure from a single sheet of metal. Here, a phosphor bronze or other similar springy and low resistance metal might be used. The non-planar features—such as mating contact portions 242 and tails 240—are then formed. If desired, the contact regions and tail regions can be plated with gold or other soft metal to enhance electrical connections either before or after the forming operation.

Features 314 are also formed in the surface of each shield strip 312A . . . 312E. When housing 220C is molded over the shield strips, features 314 will project into the insulative material, thereby locking the shield strips to the housing 220C. As illustrated, plastic is molded around three sides of each shield strip. However, plastic could be molded on all four sides of the shield strips if better adhesion is desired.

During the stamping operation, the separate shield strips 312A . . . 312E are formed. However, initially, the shield strips are not completely severed from the sheet of metal from which they are formed. Portions of the sheet (not shown) would be left joining the strips. These portions, sometimes called "carrier strips," are left in regions outside the portions of strips 312A . . . 312E that are encapsulated in housing 220C. Once the strips are encapsulated in housing 220C, the carrier strips can be cut away. Because the carrier strips provide a convenient way to handle the strips 312A . . . 312E before molding and to handle shield wafers 214, the shield wafers 214 are often left attached to the carrier strips until after the wafer assemblies 205 are formed.

FIG. 3 shows that there are five separate shield strips in shield blank 300. This configuration is contemplated for a wafer assembly 205 with five pairs of contacts. As described in more detail in conjunction with FIG. 9 below, each strip 312A . . . 312E will follow the outline of one pair of the signal conductors 218. As can be seen, each shield strip 312A . . . 312E contains a mating contact 242 and a tail portion 240. In this way, both sides of each shield strip can be connected to ground, allowing a current to flow through the shield strip. Each shield strip 312A . . . 312E forms an "active shield".

In the illustrated embodiment, the mating contact portions 242 are bent at an approximately $90^{?}$ relative to the shields trips 312A . . . 312E. This bend places the mating contact portions 242 in line with mating contact portions 224. Likewise, contact tails 240 are also are bent at an approximately $90^{?}$ relative to the shields trips 312A . . . 312E. This bend places the tails 240 in line with the tails 222.

Each shield strip 312A . . . 312E is isolated within the connector from other shield strips. This configuration has been found to improve the high frequency performance of the connector. In addition, each signal carried through the connector has its own ground shield associated with it. In the differential example illustrated herein, one differential signal is carried on a pair of conductors, meaning that there is one shield strip per pair. The spacing between the shield strip and the signal conductor can be set to control the impedance of the signal conductors, if desired.

In a preferred embodiment, the shape of the individual strips 312A . . . 312E is tailored to balance the resonant frequencies of each pair of signal conductors at the highest possible frequency. In particular, it is possible that the width of certain strips might be reduced, thereby reducing the inductance and increasing the resonant frequency. Thus, it might be desirable to have the strips associated with longer signal conductors, such as 312E, to be narrower than those associated with the shorter signal conductors. As another example, it might be desirable to cut holes in the strips, also as a way increase the resonant frequency.

Figure 4:
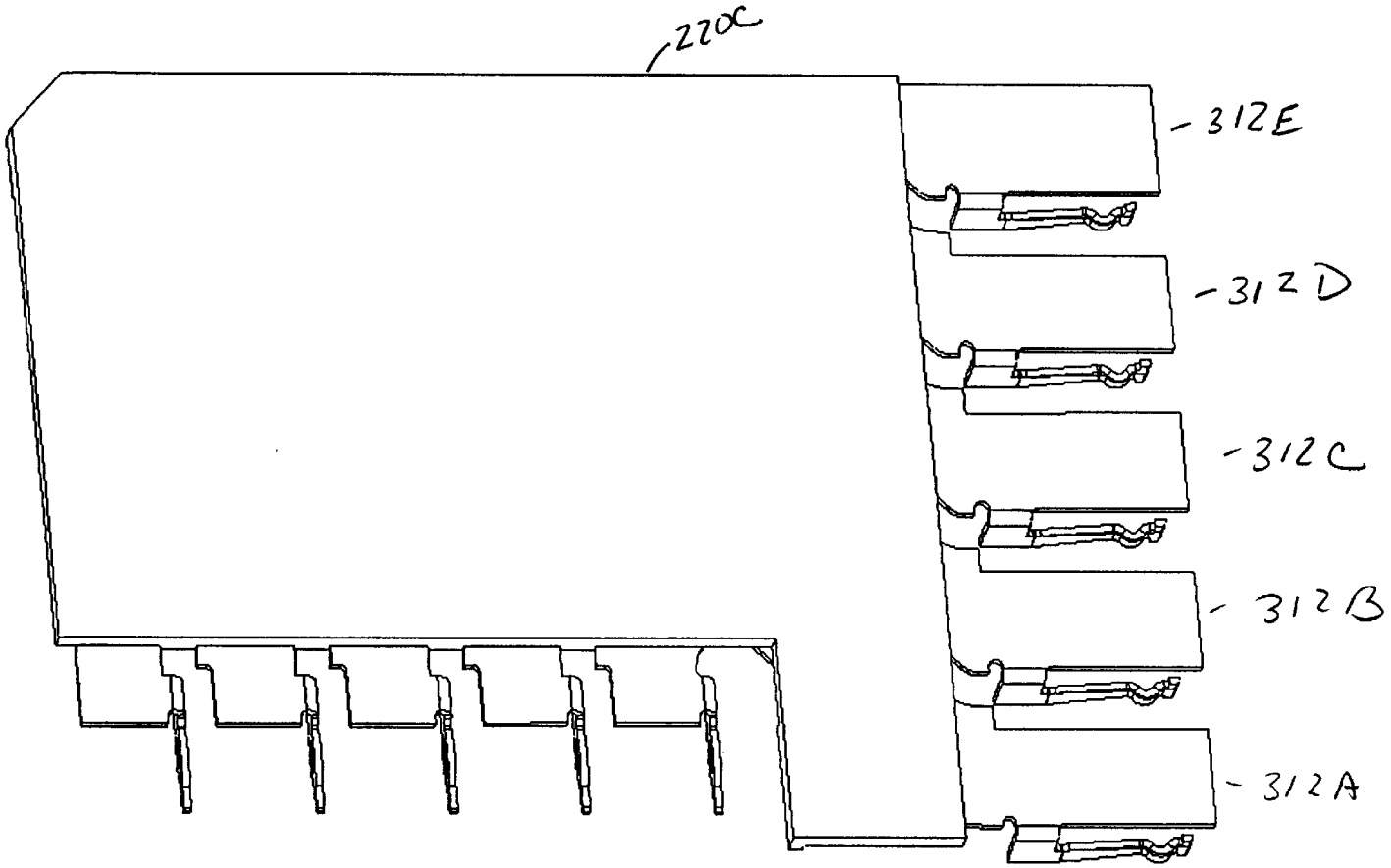
FIG. 4 is a sketch of a shield wafer used to make the connector of FIG. 2.

FIG. 4 shows the shield wafer after the shield blank 300 has been encapsulated in insulative housing 220C. Note that no insulative material has been molded in the regions of contact tails 240 or mating contact portions 242.

Figure 5:
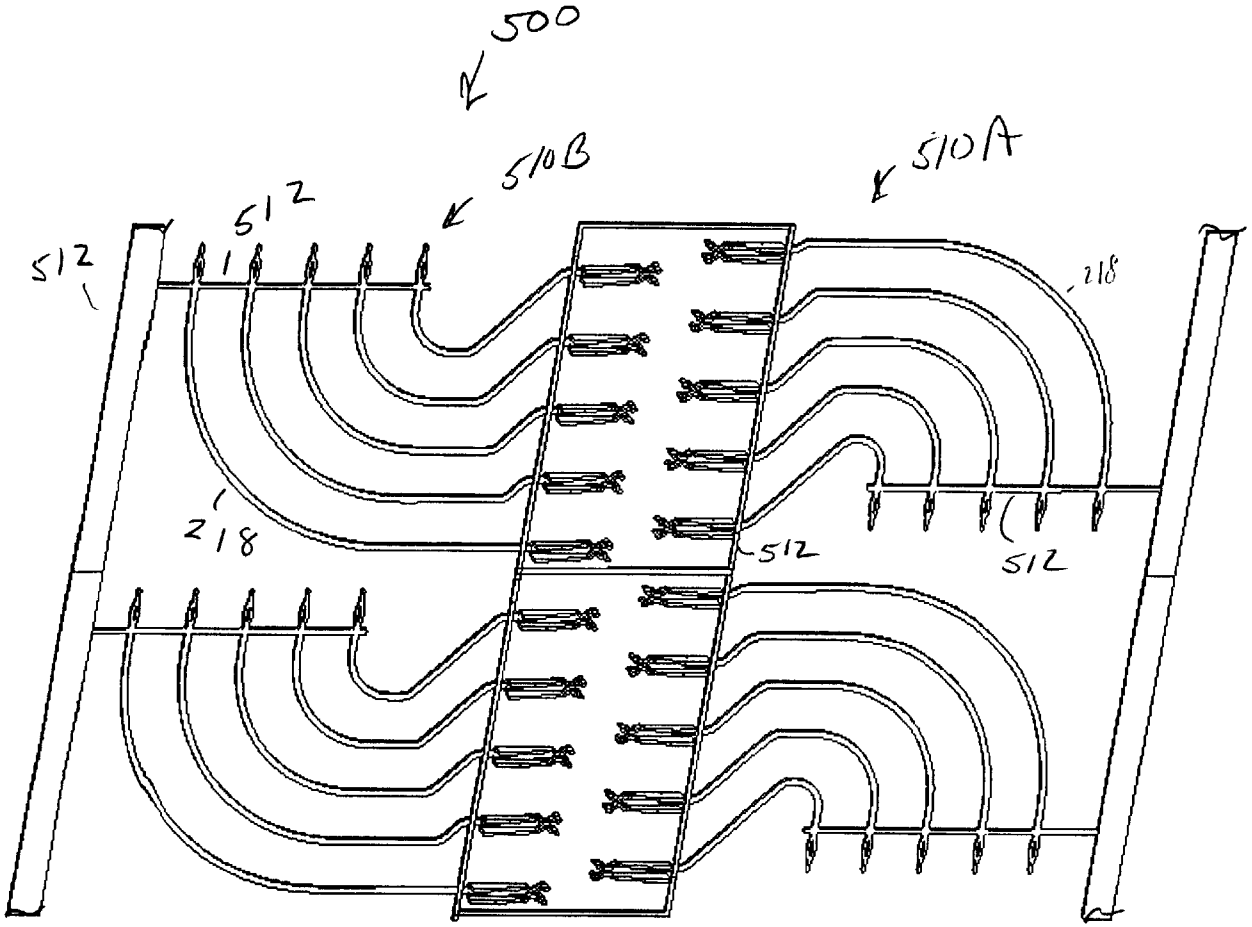
FIG. 5 is a sketch of signal blanks used to make the signal wafer of the connector of FIG. 2.

FIG. 5 shows a signal contact blank 500. Signal contact blank is stamped from a sheet of metal and the contact regions are formed. The signal contacts are initially left attached to carrier strips 512. As with the shield blanks, the carrier strips are cut off after the wafer assemblies 205 are formed or at other time when they are no longer needed for handling the signal wafers.

Signal contact blank 500 is pictured with signal contacts for four signal wafers. The contacts on side 510A are shaped for wafers of type 210. The contacts on side 510B are shaped for wafers 212. As can be seen, the signal contacts on side 510A and 510B are offset. In this way, when the contacts are molded into wafers and the wafers assembled, the contacts will be adjacent to each other.

In a preferred embodiment, the signal contacts will have intermediate portions 218 that are made of smooth curves and no angled bends. Having smooth curves or arced segments improves the high frequency performance of the electrical connector.

In the illustrated embodiment, the intermediate portions trace through a curve of $90^{?}$. It is preferable that the bend radius throughout the intermediate portion be relatively large. Preferably, the bend radius of each arc will be in excess of 1.5 times the width of the signal conductor. More preferably, the bend radius will be greater than 3 times the width of the signal conductor. In the illustrated embodiment, the bend radius is approximately 3 times the width of the signal conductor.

In a preferred embodiment, insulative housings 220A are over molded on the contacts on side 510A and housing 220B are over molded on the contacts on side 510B. Multiple wafers can be molded at one time. FIG. 5 shows signal contacts sufficient to form four signal wafers.

Figure 6:
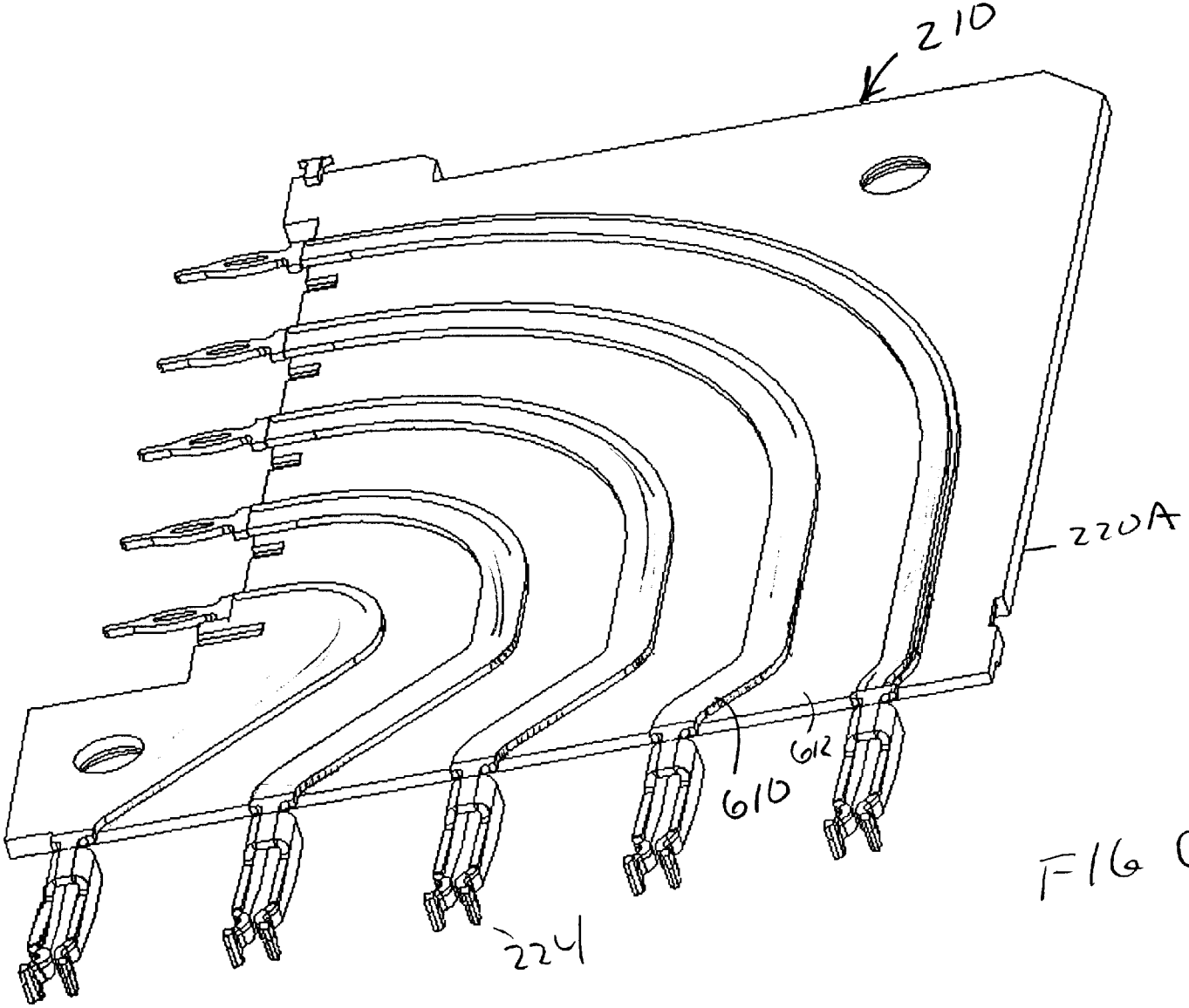
FIG. 6 is an sketch of a signal wafer of the connector of FIG. 2.

FIG. 6 shows an enlarged portion of a signal wafer 210. Intermediate portions 226 of the signal contacts are embedded in insulative housing 220A. Insulative housing 220A has an upward projection 610 around each signal conductor.

The regions 612 between the projections 610 are recessed below the level of the intermediate portions of the signal contacts. When a complementary wafer 212 is mated with a wafer 210, the projections 610 from wafer 212 will occupy the regions 612 of the wafer 210. In this way, the signal contacts will be in one column. This orientation is shown more clearly in the cross section of FIG. 8, described below.

Figure 7:
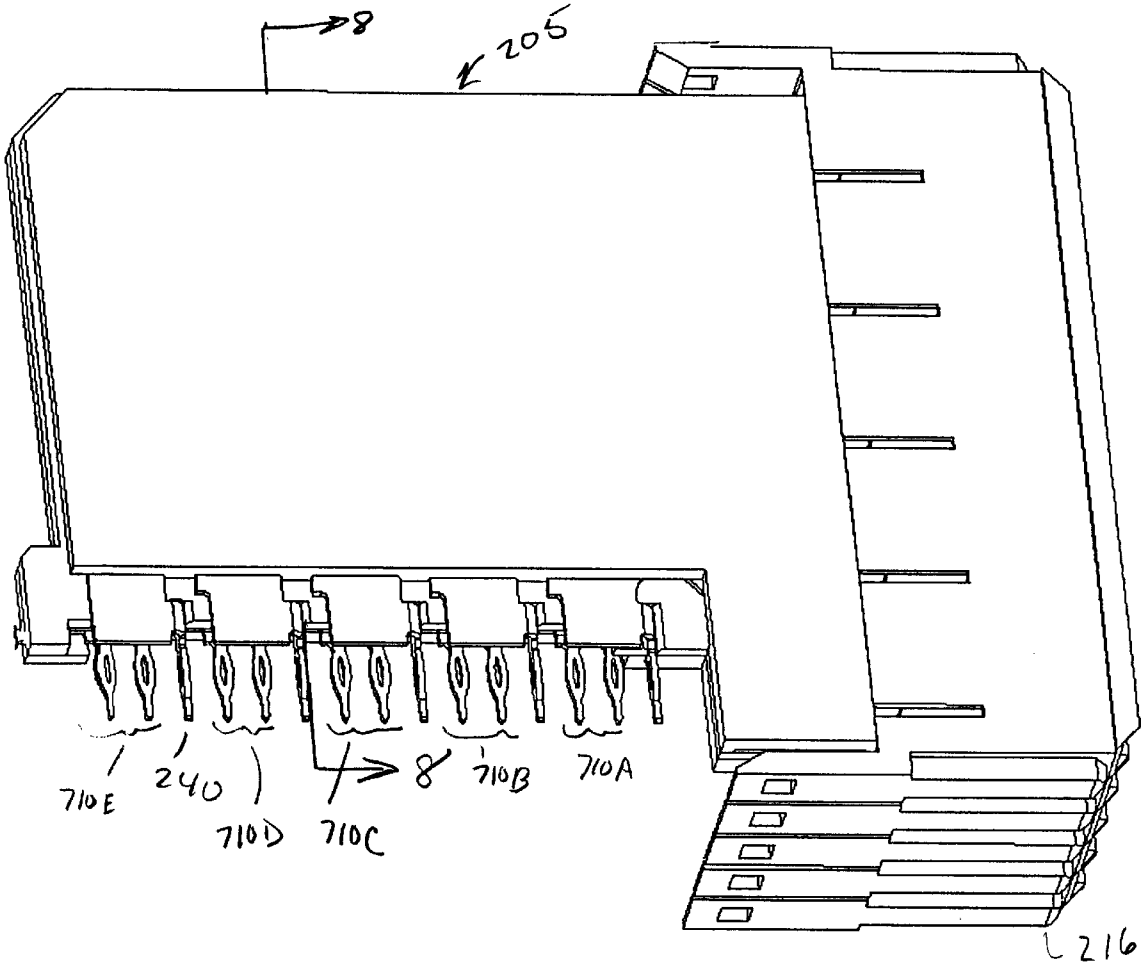
FIG. 7 is a sketch of an assembled module of the connector of FIG. 2.

FIG. 7 shows a wafer assembly 205 inserted into a cap 216. FIG. 7 shows an embodiment where cap 216 is four columns wide. To make a complete module, three more wafer assemblies would be inserted. As can be seen in FIG. 7, the completed assembly has in each column five pairs of signal contacts, 710A . . . 710E. Each pair is separated from an adjacent pair by a tail 240 of a ground strip 312A . . . 312E.

Figure 8A:
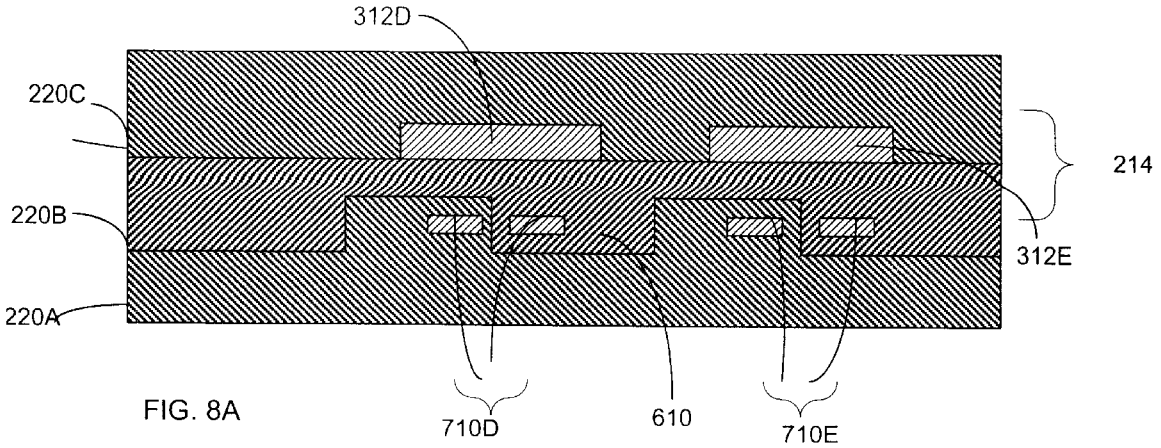
FIGS. 8A, 8B and 8C are cross sectional views of various embodiments of the module of FIG. 7 taken through the line 8—8.

Turning now to FIG. 8A, a cross section of the wafer assembly 205 taken through the line 8—8 is shown. The cross section slices through shield strips 312D and 312E, which are shown embedded in insulative housing 220C. The cross section also slices through signal contact pairs 710D and 710E. As can be seen, each of the signal contacts is in a projecting region 610, but those regions from adjacent signal wafers interlock so that the signal contacts are in a line. Also, FIG. 8A shows that the spacing between the signal contacts in a pair, such as 710A or 710D is smaller than the spacing between the pairs.

In FIG. 8A, the intermediate portion 226 of each signal contact is surrounded on four sides by the projecting region 610 of the insulative housing. This orientation can be achieved in the molding process by having small posts in one the surfaces of the mold that hold the signal contacts in place during the molding operation.

Figure 8B:
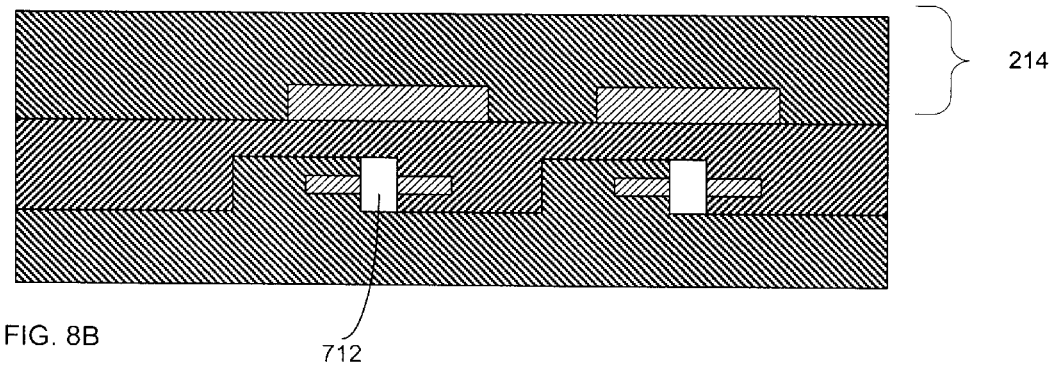

FIG. 8B. shows an alternative configuration. In the FIG. 8A, there is an air space 712 between the intermediate portions 226 of each pair. The air space can be formed in the molding operation by having a projection in the surface of the mold. Air space 712 might be desirable to increase the coupling between the signal conductors in a pair, which might reduce noise in a differential configuration. Alternatively, air space 712 might increase the impedance of the differential pair. In connector design, it is often desirable for the impedance of the signal conductors to match the impedance of traces in a printed circuit board to which the connector is attached. Thus, in some cases it will be desirable to adjust the shape of the housings 220A and 220B in the vicinity of the signal conductors in order to adjust the impedance.

Figure 8C:
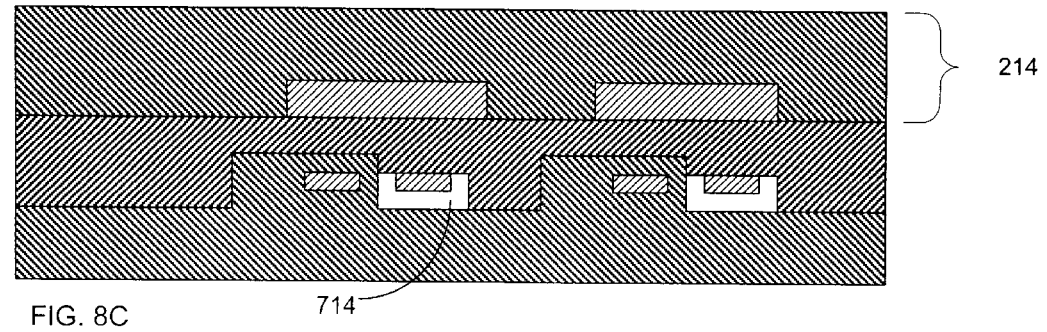

FIG. 8C shows another example of adjusting the shape of the housing to control properties of the connector. In FIG. 8C, the insulative housings 220A and 220B are molded to leave an air space 714 around three sides of the intermediate portions 226D and 226E. As can be observed in FIG. 5 and also FIG. 9 discussed below, when the signal conductors are formed into a right angle connector, the intermediate portions trace out an arc. The arc has a longer radius for the signal conductors that are further from the board. Thus, within each pair of signal conductors in a right angle, there will be one conductor in the pair with a longer intermediate portion.

However, it is generally desirable for the conductors in a differential pair to be identical. Having conductors with different lengths can cause signal distortions because of the difference in time it takes for the complementary signals to travel through each conductor of the pair. The time difference it takes for the signals in a differential pair travel through the conductors is sometimes called "skew." The air spaces 714 in FIG. 8C are formed on three sides of the intermediate portions 226D and 226E—which are part of the longer signal conductors of the pairs 710D and 710E. Air spaces 714 reduce the dielectric constant of the material around these conductors, which increases the speed at which signals travel along the conductors. Air spaces 714 therefore reduce skew.

The intermediate portions 226D and 22E pass through the insulative housings 220A and 220B along their full length. It is not necessary, however, that air spaces 714 be formed along the full length of the intermediate portions 226D and 226E. The percentage of the length of intermediate portions 226D and 226E over which air spaces 714 are formed might be varied based on the difference in length of the conductors in each pair, the dielectric constant of the insulative portions or other factors that might affect the propagation speed in the conductors. It might also be necessary that some portions of the intermediate portions 226D and 226E be surrounded on four sides with insulative material as shown in FIG. 8A in order to hold the signal conductors in place.

Figure 9A:
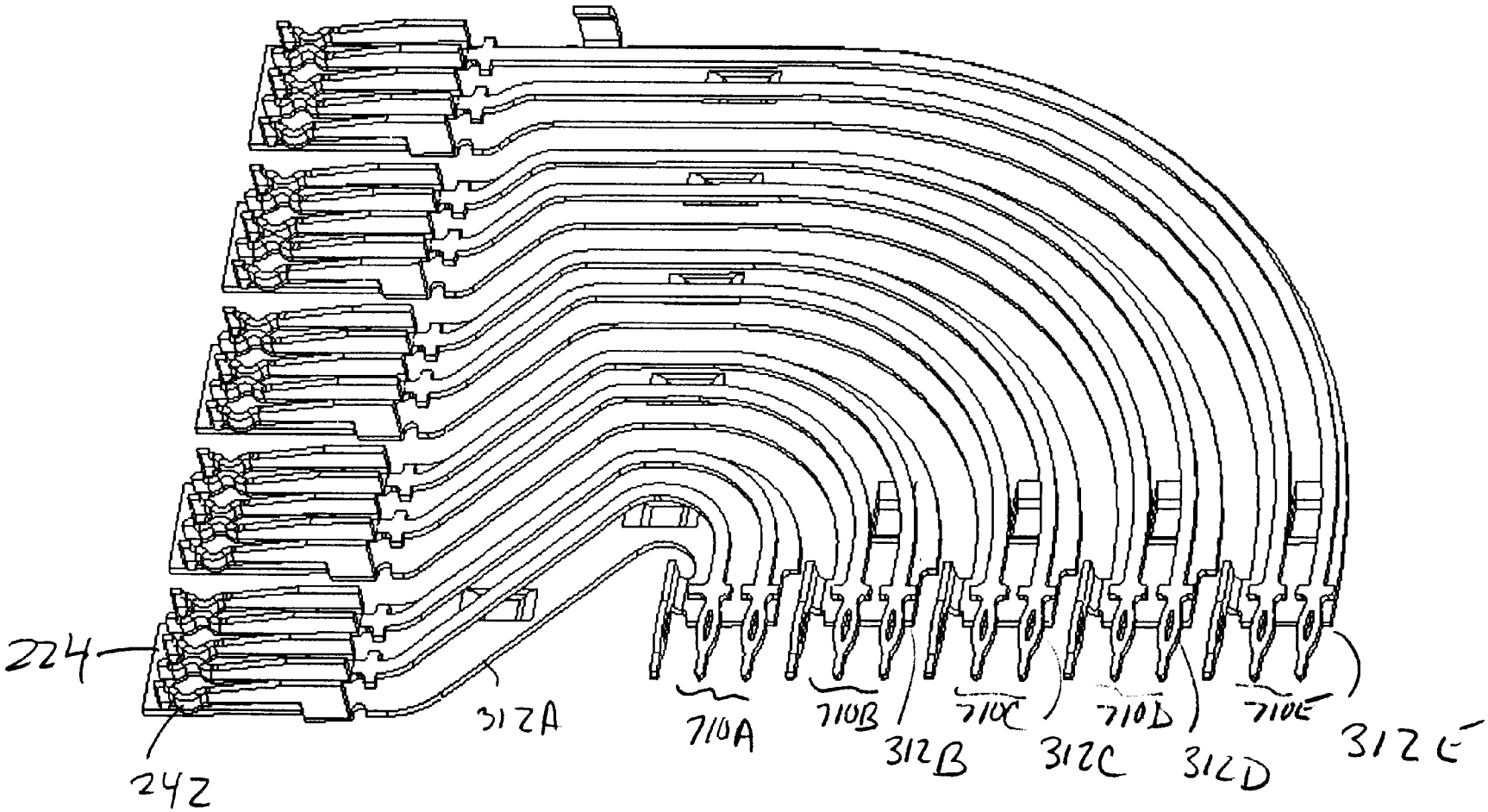
FIGS. 9A and 9B are sketches useful in understanding the relationship of signal contacts to the shield strips in an assembled module.

Turning now to FIG. 9A, the overlay of signal conductors and shield strips is shown, with the insulative housings 220A . . . 220C fully cut away. FIG. 9A shows that, within each wafer assembly the signal conductor pairs 710A . . . 710E are a uniform spacing above and a respective shield strip 312A . . . 312E. The edges of the shield strips 312A . . . 312E generally follow the contour of the signal conductors in each of the pairs 710A . . . 710E. FIG. 9 also illustrates that the mating contact portions 224 of the signal wafers are in line with the contact portions 242 of the shield strips such that each wafer assembly forms one column of contacts in the overall connector.

In FIG. 9A, it can be seen that, except in the region of holes 412 and 414, the width of each of the shield strips 312A . . . 312E (measured in the direction perpendicular to the long axis of the signal contacts) is approximately equal. In a preferred embodiment, the shield strips have a width of approximately 1.7 times the distance between the contacts in a pair.

However, it is not necessary that the shield strips 312A . . . 312E all have the same width. Because the overall connector performance is limited by the performance of the poorest performing pair, it might be desirable to increase the performance of some pairs even at the expense of others. Often, the longest leads in a connector perform the poorest.

Electrical properties of the connector might be improved by selectively reducing the inductance of the various strips. For example, the resonant frequency of each of the strips might be equalized by reducing the inductance of the longer strips, such as 312E, more than the inductance of the shorter shield strips, such as 312A. Because longer strips are inherently likely to be more inductive than shorter strips, selectively reducing the inductance of the longer strips might balance the resonant frequency of all the pairs 710A . . . 710E.

One way that the inductance might be balanced is by making the longer shield strips narrower than the shorter shield strips. However, the shield strips can not be made arbitrarily narrow because the shield strips serve to reduce cross talk between pairs. Thus, in a preferred embodiment, the width of each shield strip 312A . . . 312E will be set so that the worst cross talk for any of the pairs is as low as possible and the lowest resonant frequency of any of the pairs is as high as possible. In general, tradeoffs between cross talk and resonance will be made based on the intended application using computer simulation of the performance of the connector in conjunction with actual measurements.

Figure 9B:
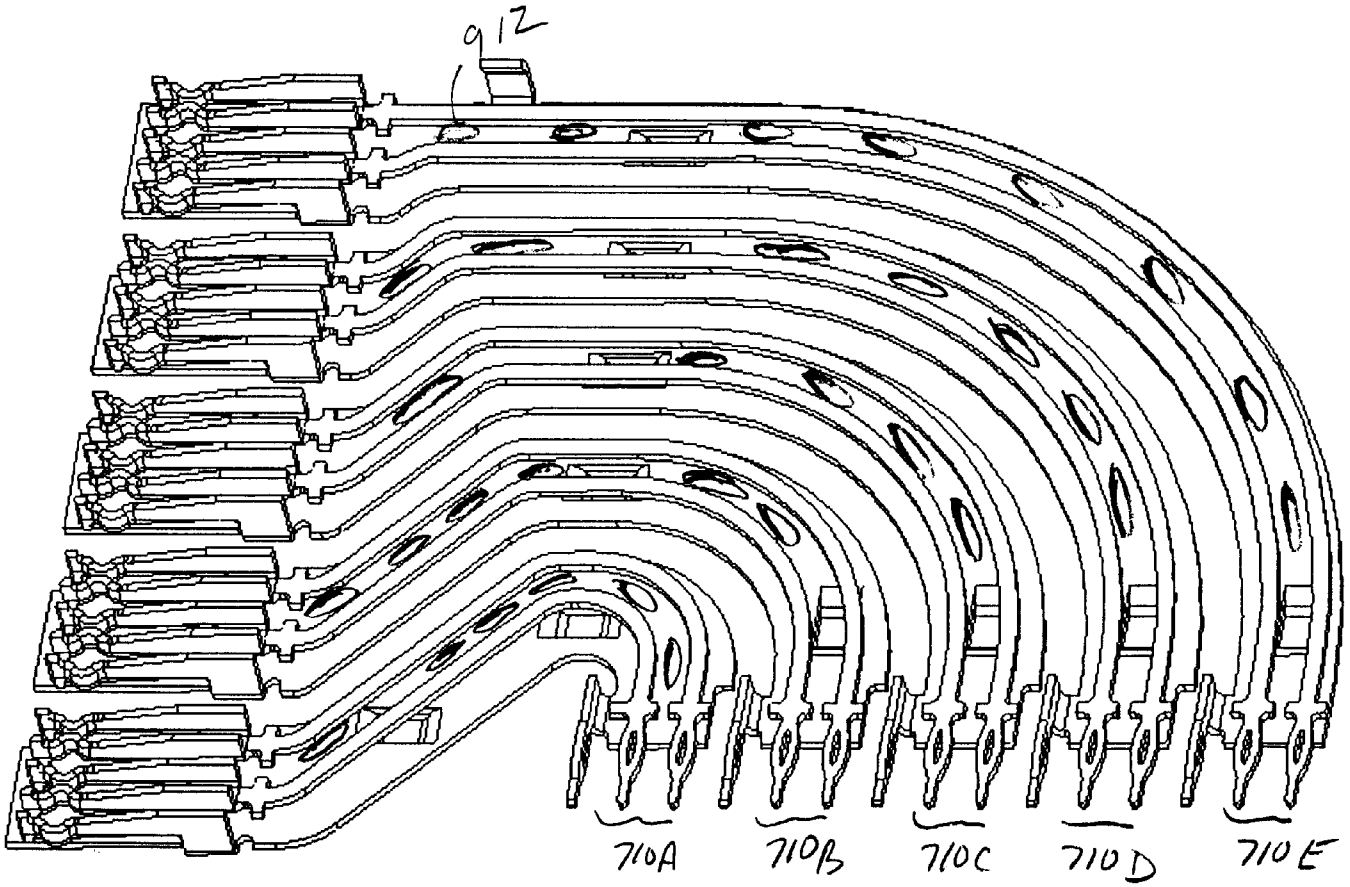

FIG. 9B shows an alternative way to reduce the inductance of the shield strips is to place slots 912 in them. In a preferred embodiment, the slots 912 in the shield strips will parallel the signal conductor pairs 710A . . . 710E. Also, it is preferable that the slots will be equidistant between the signal conductors of a pair. A slot might be continuous along the entire length of the shield strip, effectively cutting the strip into two smaller strips. However, it is not necessary that the slots be continuous. For example, it might be necessary for mechanical or other reasons that the slots in each shield strip be limited in length, more resembling a series of holes along the length of the shield strip rather than a single slot. Also, with only one grounding point at each end of each shield piece, the slots should not be so complete that they effectively severed one portion of the strip from either ground connection.

Various manufacturing processes might be used to make the above described connectors. In a preferred embodiment, it is contemplated that a signal contact blank will be stamped from a long, thin sheet of metal. The blank will contain signal contacts for many signal wafers. The signal contact blank is then be fed through a molding operation which molds the insulative housings around the signal contacts, resulting in wafers. The wafers are held on the carrier strips, which are then wound onto reels.

A similar operation is used to make the shield wafers, resulting in a long strip of shield wafers wound on a reel. The wafers are then assembled into modules in any convenient order. However, a preferred embodiment is to first join the signal wafers and then attach a shield wafer. Preferably, the wafer assemblies are held on a carrier strip until they are completely formed.

Once the wafer assemblies are completed, they are severed from the carrier strip and inserted into a cap to create a module. A plurality of modules are made and then, in a preferred embodiment, attached to a stiffener. Other components, such as guidance pins and power modules are then attached to create a complete connector assembly.

Having described one embodiment, numerous alternative embodiments or variations might be made. For example, it was described that shield strips were formed by insert molding a plastic housing around metal strips. It would be possible to form the shield strips by metalizing the outer surface of the housings on the signal wafers. The same general shielding configuration could be attained. To ground the metallized regions, ground contacts could be disposed within the signal wafers 210 or 212. Those ground contacts might then be exposed through a window in the insulative housing. As the metallization was applied, it would then make contact the expose ground contacts, thereby grounding the metallized regions.

As another example, a differential connector is described in that signal conductors are provided in pairs. Each pair is intended in a preferred embodiment to carry one differential signal. The connector could still be used to carry single ended signals. Alternatively, the connector might be manufactured using the same techniques but with a single signal conductor in place of each pair. The spacing between ground contacts might be reduced in this configuration to make a denser connector.

Also, FIG. 3 shows that mating contacts 242 are beams with a free end facing towards the mating face of the connector. It would be possible to reverse the orientation of mating contacts 242 so that their fixed ends are closer to the mating face. Improved shielding might be attained with this configuration.

Also, it was described that the shield strips are completely separate within the connector. Each of the shield strips 312A . . . 312E is connected to a common ground and the daughter card through tails 240. The shield strips might be commoned together at this point without a significant loss of performance.

Additionally, similar electrical properties might be obtained by having a solid plate that is, instead of being cut into mechanically separate strips, that is divided into strips using a series of holes or slots similar to slots 912.

Also, the connector is described in connection with a right angle daughter card to backplane assembly application. The invention need not be so limited. Similar structures could be used for cable connectors, mezzanine connectors or connectors with other shapes.

Also, various alternative contact structures might be used. For example, single beam contacts might be used instead of opposed beam receptacles. Torsional contacts, as described in U.S. Pat. Nos. 5,980,321 and 5,993,259 might be used in place of the disclosed beams. Alternatively, the position of the blades and receptacles might be reversed. Other variations that might be made include changes to the shape of the tails. Solder tails for through-hole attachment might be used. Leads for surface mount soldering might be used. Pressure mount tails might, as well as other forms of attachment might also be used.

Variations might also be made to the structure or construction of the insulative housing. While the preferred embodiment is described in conjunction with an insert molding process, the connector might be formed by first molding a housing and then inserting conductive members into the housing. Another alternative would be to mold all the signal contacts in one signal housing. Yet another alternative would be to mold the cap portion around the shield. Yet another variation would be to mold the housing of the shield wafer to have grooves in it. The signal conductors might then be pressed into the grooves to provide the appropriate positioning of the signal conductors.

Therefore, the invention should be limited only by the spirit and scope of the appended claims.

What is claimed is:

1. An electrical connector assembled from a plurality of modules aligned in parallel, each module comprising:

a) an insulative housing;

b) a plurality of signal conductors, i) each signal conductor having a mating contact portion and a contact tail and an intermediate portion therebetween, ii) with the intermediate portion disposed in the housing; and iii) the plurality of signal conductors are grouped in pairs c) a plurality of shield strips attached to the insulative housing, i) each shield strip having a contact portion and a contact tail extending from the housing; and ii) each shield strip disposed adjacent the intermediate portions of a pair of signal conductors.

2. The electrical connector of claim 1 wherein the insulative housing comprises two pieces, and wherein the signal conductors are disposed within the first piece and the plurality of shield strips are attached to the second piece.

3. The electrical connector of claim 1 wherein each shield strip has a planar surface and the planar surface is aligned in parallel with the intermediate portions of the adjacent pair of signal conductors.

4. The electrical connector of claim 3 wherein the contact portion of each shield strip extends from the shield strip at a 90 degree angle relative to the planar surface.

5. The electrical connector of claim 1 wherein the plurality of signal conductors in each module are in a single line.

6. The electrical connector of claim 1 additionally comprising:

a support member, wherein the insulative housings of each of the plurality of modules are attached to the support member.

7. The electrical connector of claim 1 wherein the insulative housing comprises a plurality of pieces, a) a first piece to which a first half of the signal conductors are attached;

b) a second piece to which a second half of the signal conductors are attached; and c) a third piece to which a plurality of shield strips are attached.

8. The electrical connector of claim 7 wherein the first piece and the second piece are shaped to interlock.

9. The electrical connector of claim 1 wherein the shield strips are mechanically separate.

10. The electrical connector of claim 1 wherein each shield strip has a plurality of holes along its length whereby the inductance of the shield strip is reduced.

11. The electrical connector of claim 1 additionally comprising an insulative cap, wherein the contact portions of the signal conductors are disposed within the cap.

12. An electrical connector assembled from a plurality of modules, each module comprising:

a) a first wafer, comprising an insulative portion with a plurality of projections; and a plurality of signal conductors each embedded in a projection of the insulative portion;

b) a second wafer, comprising an insulative portion with a plurality of projections; and a plurality of signal conductors each embedded in a projection of the insulative portions;

c) wherein the first and second wafers interlock to position the signal conductors embedded in the projections of the first wafer and the signal conductors embedded in the projections of the second wafer in a plane; and d) wherein the module additionally comprises a shield member parallel to the plane.

13. The electrical connector of claim 12 wherein the shield member comprises a plurality of segments.

14. The electrical connector of claim 13 wherein each shield segment has a mating contact and a contact tail.

15. The electrical connector of claim 13 wherein each shield segment has a plurality of holes therein.

16. The electrical connector of claim 13 wherein the signal conductors from the first type wafer and the second type wafer are aligned in pairs, with a shield segment adjacent each pair.

17. The electrical connector of claim 12 wherein the signal conductors from the first type wafer and the second type wafer are aligned in pairs with air gaps around the signal conductors in the second type wafer.

18. The electrical connector of claim 12 wherein the signal conductors from the first type wafer and the second type wafer are aligned in pairs with air gaps between the signal conductors in the second type wafer and the first type wafer.

19. An electrical connector comprising assembled from a plurality of modules, comprising:

a) an insulative cap;

b) a plurality of modules attached to the cap, each module comprising:

i) a plurality of signal conductor having a mating contact portion and a contact tail and an intermediate portion therebetween, with the intermediate portion disposed in the housing; and the plurality of signal conductors are grouped in pairs ii) a plurality of shield strips attached to the insulative housing, each shield strip having a contact portion and a contact tail extending from the housing; and each shield strip disposed adjacent the intermediate portions of a pair of signal conductors;

c) wherein the mating contact portions are inside the cap.

20. The electrical connector of claim 19 wherein the shield strips are mechanically separate.

* * * * *